US006182290B1

(12) United States Patent
Morris

(10) Patent No.: US 6,182,290 B1
(45) Date of Patent: Feb. 6, 2001

(54) EASY-ON-AND-OFF ADJUSTABLE PROTECTIVE COVERING

(76) Inventor: Bert W. Morris, 465 La Corjo Circle, Walnut Creek, CA (US) 94598-2237

( * ) Notice: Under 35 U.S.C. 154(b), the term of this patent shall be extended for 0 days.

(21) Appl. No.: 09/275,156

(22) Filed: Mar. 24, 1999

Related U.S. Application Data

(63) Continuation-in-part of application No. 09/055,066, filed on Apr. 3, 1998, now Pat. No. 5,930,836.
(60) Provisional application No. 60/042,657, filed on Apr. 4, 1997.

(51) Int. Cl.[7] ..... A41B 13/10
(52) U.S. Cl. ..... 2/49.1; 2/49.2; 2/52
(58) Field of Search ..... 2/48, 49.1, 49.2, 2/49.3, 49.4, 49.5, 50, 51, 52

(56) References Cited

U.S. PATENT DOCUMENTS

| | | | | |
|---|---|---|---|---|
| D. 232,134 | * | 7/1974 | Andersson et al. | D2/226 |
| 2,164,369 | | 7/1939 | Woolever | 2/49 |
| 2,367,383 | | 1/1945 | Tiscornia | 2/49 |
| 2,440,666 | | 4/1948 | Miller | 2/49 |
| 2,763,867 | * | 9/1956 | Chagnon . | |
| 2,782,420 | | 2/1957 | Barager | 2/49 |
| 3,001,646 | | 9/1961 | Cooper | 206/58 |
| 3,328,807 | | 7/1967 | Strauss | 2/49 |
| 3,416,157 | | 12/1968 | Marder et al. | 2/49 |
| 3,995,321 | | 12/1976 | Johnson | 2/49 R |
| 4,114,199 | | 9/1978 | Malan | 2/49 A |
| 4,233,688 | | 11/1980 | Hjerl | 2/49 R |
| 4,416,025 | | 11/1983 | Moret et al. | 2/49 R |
| 4,441,212 | | 4/1984 | Ahr et al. | 2/49 R |
| 4,445,231 | | 5/1984 | Noel | 2/49 R |
| 4,495,658 | | 1/1985 | Moret et al. | 2/49 R |
| 4,523,333 | | 6/1985 | Spangler | 2/49 R |
| 4,523,334 | | 6/1985 | Lavash | 2/49 R |
| 4,601,065 | | 7/1986 | Sigl et al. | 2/49 R |
| 4,646,364 | | 3/1987 | O'Larey | 2/49 R |
| 4,649,572 | | 3/1987 | Roessler | 2/49 R |
| 4,660,224 | | 4/1987 | Ashcraft | 2/48 |
| 4,797,952 | * | 1/1989 | Petrini | 2/49 R |
| 4,884,299 | | 12/1989 | Rose | 2/49 R |
| 5,483,701 | | 1/1996 | Ferreyros | 2/49.2 |
| 5,530,968 | | 7/1996 | Crockett | 2/46 |
| 5,661,851 | | 9/1997 | Sanchez | 2/49.1 |
| 5,715,542 | | 2/1998 | Reinhart, Jr. | 2/49.1 |
| 5,809,568 | * | 9/1998 | Morris-Jones | 2/49.1 |

* cited by examiner

*Primary Examiner*—Amy B. Vanatta

(57) ABSTRACT

An easy-on-and-off adjustable protective covering provides maximum protection from liquid and solid spills at the lowest possible cost. The maximum protection comes from: (1) the use of a liquid absorbent surface on the front side (2) the use of a liquid repellent surface on the back side (3) the ability to provide a custom fit for different neck sizes (4) the ability to adjust the tightness of fit around the neck to prevent liquid spills from running down the neck (5) an easy-on-easy-off attachment means that is convenient to use and eliminates the choking hazard of tied straps and (6) a protruding pocket at the bottom to catch and retain spills and runoff. The lowest possible cost comes from: (1) the ability to use readily available materials including recycled materials (2) the ability to use inexpensive disposable materials without sacrificing performance (3) the ability to use the manufacturing and distribution infrastructure already in place for other products (4) a rectangular design that minimizes production scrap (5) a one-size-fits-all design that minimizes inventory, stocking and ordering costs and (6) an attachment means that permits repeated use, even with disposable materials, thus reducing the cost per use.

17 Claims, 3 Drawing Sheets

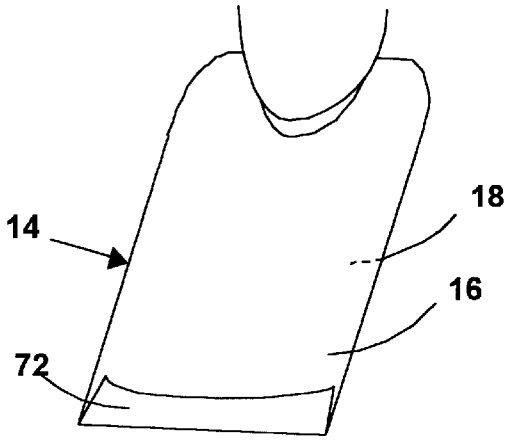
FIG. 1-A
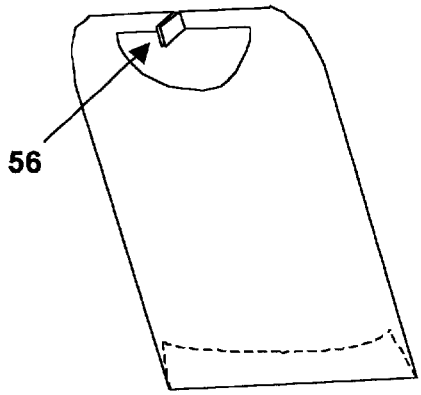
FIG. 1-B
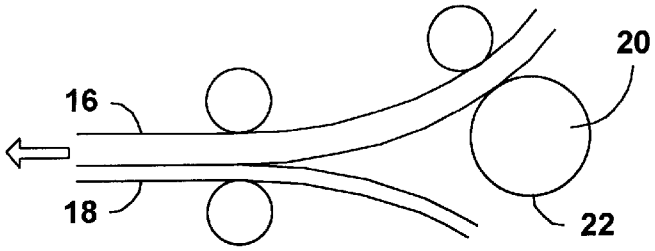
FIG. 2-A
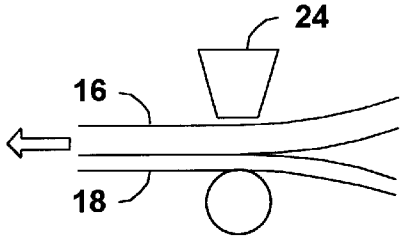
FIG. 2-B
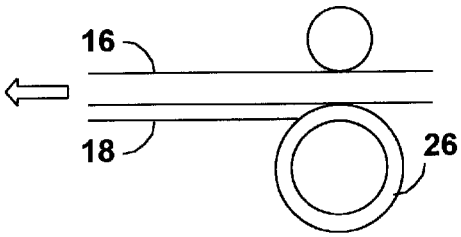
FIG. 3-A
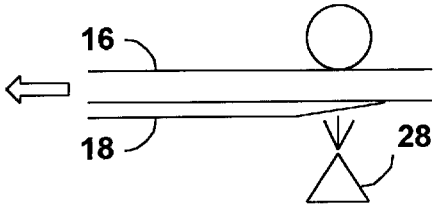
FIG. 3-B
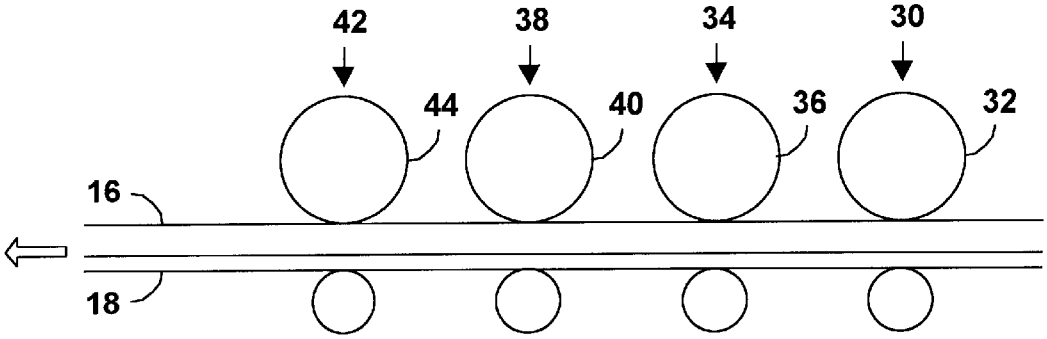
FIG. 4

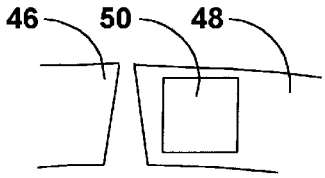
Prior Art
FIG. 5-A
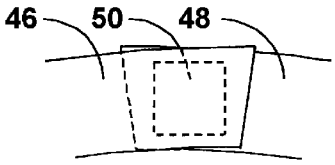
Prior Art
FIG. 5-B
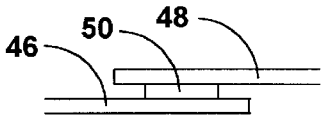
Prior Art
FIG. 5-C
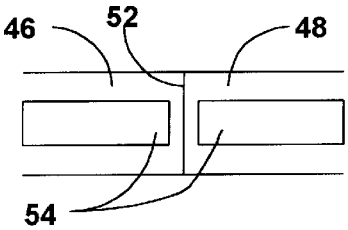
FIG. 6-A
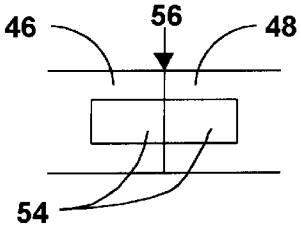
FIG. 6-B
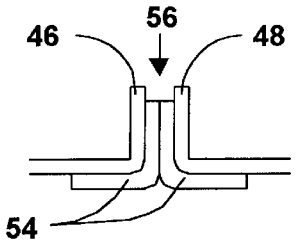
FIG. 6-C
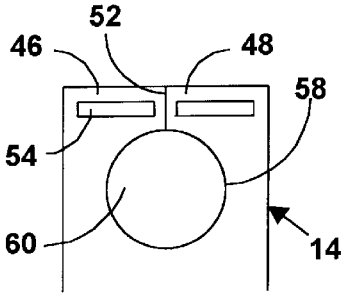
FIG. 7-A
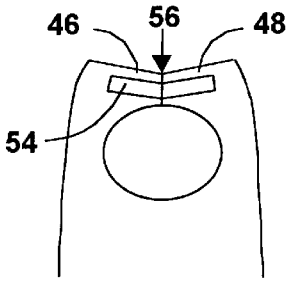
FIG. 7-B
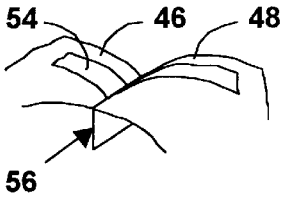
FIG. 7-C
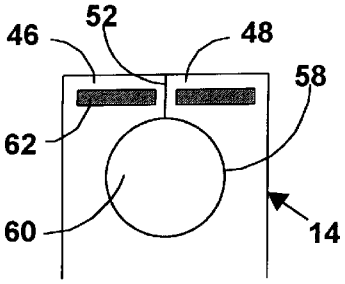
FIG. 8-A
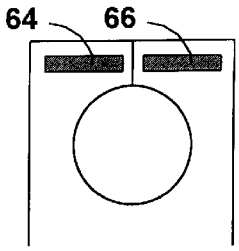
FIG. 8-B
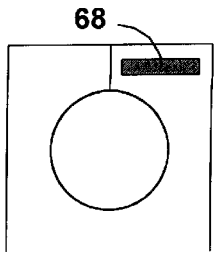
FIG. 8-C

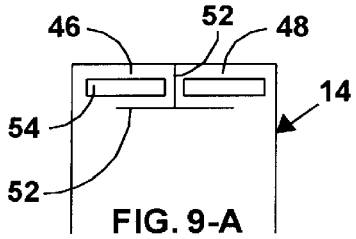
FIG. 9-A
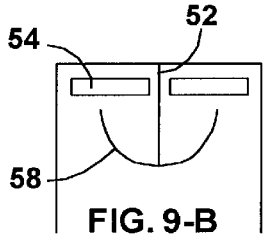
FIG. 9-B
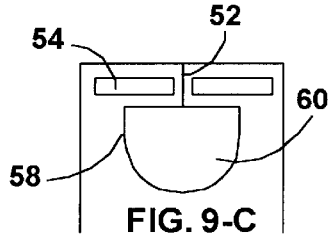
FIG. 9-C
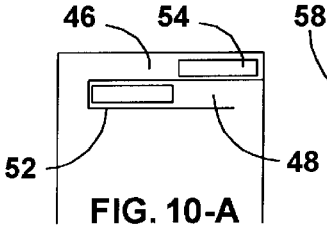
FIG. 10-A
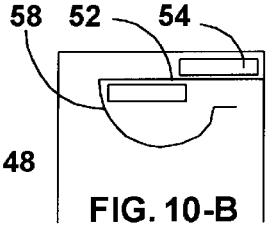
FIG. 10-B
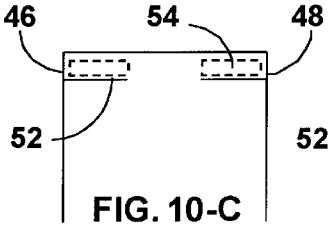
FIG. 10-C
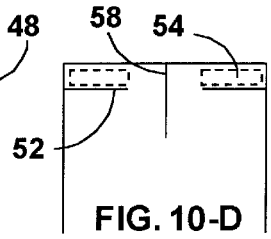
FIG. 10-D
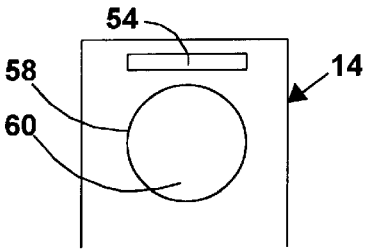
FIG. 11-A
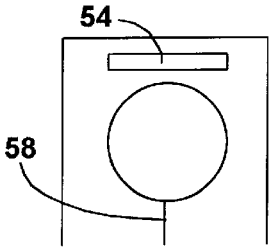
FIG. 11-B
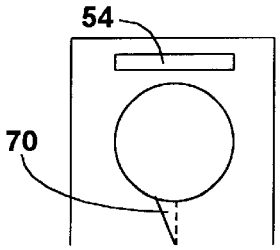
FIG. 11-C
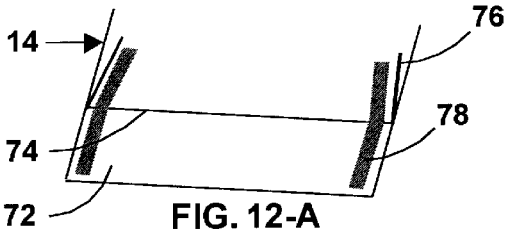
FIG. 12-A
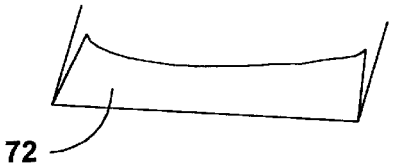
FIG. 12-B
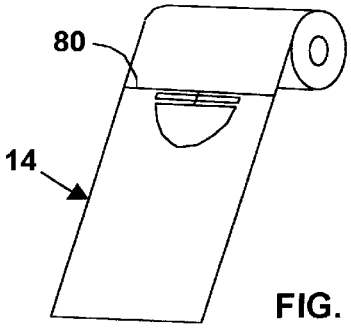
FIG. 13-A
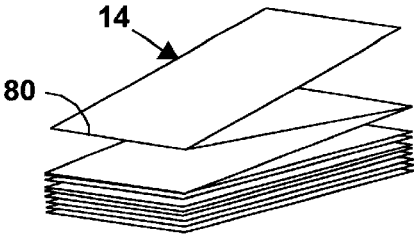
FIG. 13-B

EASY-ON-AND-OFF ADJUSTABLE PROTECTIVE COVERING

CROSS-REFERENCE TO RELATED APPLICATION

This is a continuation-in-part of application No. 09/055,066, filed Apr. 3, 1998 now U.S. Pat. No. 5,930,836.

BACKGROUND

That application disclosed an inexpensive-to-make covering with high performance features including the ability to custom fit a covering to different neck sizes and tightness around the neck. The custom fitting was accomplished by selectively -folding a top of a covering over a transverse axis onto itself. This application discloses an invention that has the same low cost and high performance features but uses a different fitting method. The fitting is accomplished by selectively folding a top of a covering around a central vertical axis onto itself An underlying feature of both applications is that a very effective protective covering can be made from paper toweling even though that material has only an 11-inch width.

1. Field of the Invention

This invention relates to garment protectors, specifically coverings that protect a wearer's skin and clothing from liquid and solid spills.

2. Prior Art

There are ongoing needs to protect skin and clothing in dental, industrial, medical and personal service situations. The needs are ongoing because some needs are not being met with the most cost-effective protective covering products. Some protective coverings are made from materials that are unnecessarily heavy or expensive. Coverings made from heavy materials are hot and uncomfortable to wear. Furthermore, some products have ineffective ways of adjusting the fit of the covering on the wearer.

A situation where the needs are not being met at all is the protection of skin and clothing from spills while eating and drinking. Those with the greatest needs in this area are infants, young children, people wearing clothes that cannot be spotted, people eating in vehicles and airplanes, seniors and the bedridden. With the exception of plastic coverings used in some seafood restaurants, there are no successful coverings on the market for protection against food and drink spills. The reasons for this are clear. An eating covering must be practical, effective and very inexpensive. Inventions to date have not met these requirements.

A review of prior art revealed why such desirable coverings are not on the market. Some covering designs required expensive materials. Some designs did not have the preferred characteristics of an absorbent top surface and a moisture barrier next to the wearer. Some had odd shapes that would generate scrap and thus increase production costs. Many had add-on pieces like snaps, attachment pads, adhesive strips and stitching that increase production costs. Some neglected to incorporate an effective pocket to catch and retain spills. Some disposable designs could not be reused which greatly increases the cost-per-use of such a covering.

There was a notable lack of a low cost design that included: (1) an easy means of attaching the covering (2) the ability to easily fit the covering to various neck sizes (3) the ability to easily adjust the tightness of fit around the neck (4) an easy means of releasing the attachment and (5) the ability to reattach the covering for repeated use. While attempts to meet these criteria looked good on paper, testing by the applicant proved that many were impractical. Mechanical attachments like buttons and snaps are too costly. Neck straps are hard to tie behind one's neck, are difficult to untie and pose a choking hazard while attached. Adhesives and other attachments applied to both the front and rear surfaces of a covering increase the production cost and can cause one covering to stick to another when packaged. Some designs showed exposed adhesive depositions on just one of two connecting surfaces. To adhere, that adhesive must be very tacky. This too can cause that problem of one covering sticking to another in a package. Furthermore, the required tackiness can make it difficult to release the connection. Other attachment designs did not seem suitable for repeated reuse.

A capability to adjust the fit is probably the most important feature if an inexpensive protective covering is to be successful. Most prior art designs seemed to provide an adequate means of connecting a covering to a wearer (although a significant number disclosed impractical or questionable connections). Without a custom-fitting means however, the neck opening in the covering is going to be too large or too small for many users. Thus, the coverings will not provide complete protection or they will be uncomfortably tight. With no fit adjustments, the only solution is to provide coverings with different neck hole sizes but this adds unnecessary inventory, stocking and ordering costs. Of the coverings that did disclose an adjustment feature, many just included a few words in the specification to the effect that "additional attachment points could be used to adjust the fit." The fit adjustments were not part of the basic design in those cases and that capability was not disclosed in the drawings or claims.

How the fit is accomplished is important too. If the fitting process is awkward or time-consuming, consumers will not be interested. The fitting mechanism must provide for easy attachment, easy fit adjustment, easy detachment and easy reuse. No prior art covering designs were as effective in these areas as what is disclosed in this application.

OBJECTS AND ADVANTAGES

Accordingly, several objects and advantages of the invention that will ensure the lowest cost of manufacturing and distribution are:

(a) Common and inexpensive materials such as paper toweling and plastic film can be used so material costs will be low (b) Recycled materials can be used to further reduce material costs (c) A rectangular design minimizes scrap costs (d) One size can fit all so inventory, stocking and ordering costs are minimized (e) There are no individual production operations (which are costly) because all manufacturing can be done in a continuous manner on a web of material (f) The attachment means are located on only one side of the material so production costs are less (g) The covering can be produced and packaged using existing production resources thus reducing capital investment costs (h) Packaged coverings can be sold through existing retail channels thus keeping the costs of distribution low.

Furthermore, several objects and advantages of the invention that will ensure the highest performance and consumer satisfaction are:

(a) Coverings can be made from material with an I1 -inch width so they can be sold in a roll that fits standard paper towel holders, making the coverings easy to store and dispense (b) One size can fit both children and adults so one size can fit a family (c) Coverings can have the desirable liquid absorbent top surface and liquid repellent bottom surface (d) The design includes an effective pocket at the bottom to catch debris and liquids and retain them (e) The covering is adjustable for neck size for better fit, comfort and performance (f) The covering is adjustable for closeness of fit around the neck so it can catch spills that otherwise would run down the wearer's neck (g) The covering is very easy to attach and detach and the design allows for repeated use even with low-cost disposable materials (h) The difficulty of untying straps and the choking hazard associated with them is not a problem because there are no straps to tie (i) The attachment means are on one side of the material so adjacent coverings will not stick to each other when packaged (j) It is easy to attach the neckbands behind one's head because accurate alignment of the connecting areas is not required (k) Connecting a covering on a wearer is a simple matter of pressing opposing neckbands together with the thumbs (l) The fitting is accomplished with a single sliding motion using a thumb and finger to press the neckbands together along their length (m) Detachment of a covering is particularly easy because it only requires pulling opposing neckbands apart Other objects and advantages are:

(a) Any material removed to make a neck hole makes an effective coaster or wiping rag (b) A covering as a sheet of material makes an effective napkin for lap protection and an excellent burp pad for bottle-feeding infants Further objects and advantages of the invention will become apparent from a consideration of the drawings and ensuing description.

DRAWING FIGURES

In the drawings, closely related figures have the same number but different alphabetic suffixes.

FIGS. 1-A and 1-B show front and rear views of the invention

FIGS. 2-A and 2-B show methods for laminating covering materials

FIGS. 3-A and 3-B show methods for applying a liquid repellent surface to material FIG. 4 shows printing, deposing of neckband and pocket attachment means and perforating operations FIGS. 5-A, 5-B and 5-C show a typical neckband connection found in prior art FIGS. 6-A, 6-B and 6-C show before-and-after views of the invention's neckband connection design FIGS. 7-A, 7-B and 7-C show additional before-and-after views of the neckband connection design FIGS. 8-A, 8-B and 8-C show adhesive, mechanical and single-side neckband attachment means for connecting and fitting neckbands FIGS. 9-A, 9-B and 9-C show neckband attachment means on coverings with vertical neckband separation perforations at the top of the coverings FIGS. 10-A, 10-B, 10-C and 10-D show neckband attachment means on coverings with horizontal neckband separation perforations FIGS. 11-A, 11-B and 11-C show neckband attachment means on over-the-head types of coverings FIGS. 12-A and 12-B show a bottom of a covering being folded-up to make a protruding pocket FIGS. 13-A and 13-B show roll and fanfold packaging of coverings

REFERENCE NUMERALS IN DRAWINGS

14 protective covering
16 liquid absorbent surface
18 liquid repellent surface
20 adhesive drum
22 lamination adhesive
24 ultrasonic wave generator
26 roller or drum
28 liquid repellent sprayer
30 printing process
32 printing drum
34 neckband attachment process
36 neckband adhesive drum
38 pocket attachment process
40 pocket adhesive drum
42 perforation process
44 perforation roller or drum
46 left neckband
48 right neckband
50 prior art attachment means
52 neckband separation perforations
54 elongated attachment means
56 connected neckbands
58 neck hole separation perforations
60 neck hole material
62 adhesive or cohesive strip
64 strip of "hooks"
66 strip of "eyes"
68 single-side adhesive strip
70 adhesive-secured flap
72 fold-up bottom that forms a pocket
74 printed fold line
76 printed attachment guideline
78 pocket-making adhesive
80 covering separation perforations

SUMMARY OF THE INVENTION

In accordance with the present invention, an easy-on-and-off adjustable protective covering comprises a flexible material that can have a liquid absorbent top surface and a liquid repellent back surface. It uses a simple "touch-together-then-pinch-and-slide" technique that enables a covering to be easily attached, custom-fitted to the wearer and adjusted to provide the desired closeness of fit around the neck. A wearer can easily connect neckbands behind the neck because precise alignment of the neckbands is not required. Detachment requires just pulling the neckbands apart. One size can fit all thereby reducing manufacturing and retailing costs and adding to consumer convenience. The bottom of a covering can be folded-up to form a protruding pocket. If neck hole material is removed, it can make an effective coaster or wipe.

A covering can be produced from common, inexpensive, recycled materials, even materials such as paper toweling with a plastic film backing. Furthermore, coverings can be produced, packaged, distributed and retailed in a roll having the same diameter and 1I -inch width as a roll of paper towels. Thus, coverings can be produced using existing paper towel production and distribution facilities. Furthermore, consumers can use standard paper towel holders to hold a roll of coverings and dispense them in a tear-off manner like paper towels.

Description—FIGS. 1 to 13

FIGS. 1-A and 1-B show front and rear views of the invention, an adjustable, wearable protective covering 14. The covering shown has a liquid absorbent front surface 16 and a liquid repellent back surface 18. Other materials are possible that have a single liquid characteristic like absorbent or repellent or have a combination of characteristics like absorbent-repellent-absorbent in layers. Neckbands form connected neckbands 56 by the wearer pressing together opposing neckband surfaces on which an elongated attachment means has been deposed. Custom fitting is accomplished by selectively increasing the area of neckband contact. The covering has a fold-up bottom that forms a pocket 72.

FIGS. 2-A and 2-B show two methods of laminating different materials on a web production line to form a layered covering material. In the drawings, a material with a liquid absorbent surface 16 is being laminated to a material with a liquid repellent surface 18. FIG. 2-A shows use of an adhesive drum 20 to apply a lamination adhesive 22. FIG. 2-B shows use of an ultrasonic wave generator 24 and pressure to bond two plies of fibrous material together by melting thermally fusible plastic fibers embedded in both plies at their contacting surfaces.

FIGS. 3-A and 3-B show two methods for applying a liquid repellent surface 18 to material having a liquid absorbent surface 16 on a web production line. FIG. 3-A shows use of a roller or drum 26 to apply a repellent material by direct contact. FIG. 3-B shows a repellent being applied by a liquid repellent sprayer 28. Covering material may also be made in the form of a multi-layered nonwoven web by melt-blowing layers of microfibers having hydrophobic and hydrophilic characteristics.

FIG. 4 shows four manufacturing operations being performed on a web of covering material. A printing process 30 employs a printing drum 32, or ink sprayer, to print pocket folding and attachment guidelines, a decorative design, and advertising on the material. A neckband attachment process 34 deposes a means of attaching neckbands to each other on the material. In the drawing, a neckband adhesive drum 36 applies an adhesive (or cohesive) neckband attachment means (cohesive being defined as not tacky by itself but capable of making a secure connection when cohesive areas contact each other). A pocket attachment process 38 deposes a means of attaching a pocket at the bottom of a covering on the material. In the drawing, a pocket adhesive drum 40 applies an adhesive (or cohesive) pocket attachment means. A perforation process 42 employs a perforation roller or drum 44 to perforate the material. Perforations allow easy removal of a covering from a continuous roll or fanfold stack and for separation of neckbands and neck holes. When coverings are packaged individually, the covering removal perforation operation is replaced with a cut-off operation.

FIG. 5-A shows a common means disclosed in prior art for connecting a covering on a wearer. Two neckband ends, 46 and 48, are designed to be joined in an overlapping manner using an attachment means 50, usually adhesive, to hold the ends together. Typically, it is a single point connection with no adjustments for fit.

FIG. 6-A shows a construction of the invention's neckbands. Neckband separation perforations 52 create left 46 and right 48 neckbands when the perforations are broken. An elongated attachment means 54 is deposed on each neckband. The attachment means can be deposed on either the front or back surface of the material depending on the covering size, design and type of material. The attachment areas are much longer than needed to hold a covering in place on a wearer. By providing a range of points to contact, a wearer can select the contact points that give the desired fit.

FIG. 7-A shows the upper portion of a protective covering 14 with an oval neck hole before any perforations are broken. Neckband separation perforations 52 are connected to neck hole separation perforations 58. When all perforations are broken, left 46 and right 48 neckbands are created and a piece of neck hole material 60 is separated from the covering for use as a coaster or wipe. An elongated attachment means 54 is deposed on each neckband. Thus, a range of neckband attachment points is provided on the neckbands.

FIGS. 8-A, 8-B and 8-C show elongated attachment points at the top of a covering for three different types of attachment means. Attachment points on one neckband connect selectively to attachment points on the other neckband to retain the covering on a wearer and give the desired fit at the neck area. Having ranges of attachment points on the neckbands allows for an adjustable customized fit since only one point on one neckband is needed to make a connection with one point on the opposing neckband. The multiple attachment points on both neckbands have the effect of allowing the neckbands to be shortened thus tightening the covering's fit on the wearer without physically changing their length. FIG. 8-A shows a protective covering 14 having neckband separation perforations 52 connected to neck hole separation perforations 58. When the perforations are broken, left 46 and right 48 neckbands are created together with a piece of neck hole material 60 that can be used as a coaster or wipe. FIG. 8-A shows an adhesive (or cohesive) strip 62 attachment means. FIG. 8-B shows a mechanical attachment means using a strip of "hooks" 64 and a strip of "eyes" 66. FIG. 8-C shows a single-side adhesive strip 68 attachment means on one neckband that is capable of making a secure connection to the material on the opposing neckband. Depending on the characteristics of the adhesive and covering material, adhesive of this tackiness could require a protective covering over the strip until it is ready for attachment. It is important to note that all neckband-to-neckband attachment means are designed for: (1) easy connect (2) easy disconnect (3) easy disconnect in a potential strangling situation and (4) the capability for repeated attachment and detachment. Even coverings made from disposable materials can be reused until the covering surface is no longer serviceable.

FIGS. A-9, 9-B and 9-C show an elongated attachment means 54 on the neckbands of three covering designs that have vertical neckband perforations originating from the center of a covering's top edge. FIG. 9-A shows vertical neckband separation perforations 52 connecting to horizontal neckband separation perforations 52. FIG. 9-B shows a longer length of vertical neckband separation perforations 52 connecting to a semi-circle of neck hole separation perforations 58 that form a neck hole in the covering when the perforations are broken. FIG. 9-C shows vertical neckband separation perforations 52 connecting to U-shaped neck hole separation perforations 58 that form a neck hole in the covering and a separate piece of neck hole material 60 when the perforations are broken.

FIGS. 10-A through 10-D show an elongated attachment means 54 on the neckbands of four covering designs that have horizontal neckband perforations originating from a covering's side edges. FIG. 10-A shows parallel neckband separation perforations 52 that create long left 46 and right 48 neckbands when the perforations are broken. FIG. 10-B shows neck hole separation perforations 58 that create a neck hole in a covering when broken. FIG. 10-C shows opposing neckband separation perforations 52 that form neckbands that wrap around a wearer's neck like a collar when attached. Note that the elongated attachment means 54 is deposed on the back side of the material in this design. FIG. 10-D is like the design in FIG. 10-C with the addition of vertical neck hole separation perforations 58 that facilitate the attachment and fitting.

FIGS. 11-A, 11-B and 11-C show an elongated attachment means 54 across the top of three over-the-head covering designs. FIG. 11-A shows a protective covering 14 with oval neck hole separation perforations 58. When the perforations are broken, a separate piece of neck hole material 60 is created for use as a coaster or wipe. Of course, in this and in other designs with a removable piece of neck hole material 60, coverings can be packaged as individual units with the neck hole material already removed. FIG. 11-B shows a covering with vertical neck hole separation perforations 58 that aid in getting the covering over the head. FIG. 11-C shows a covering with an adhesive-secured flap 70 that closes the vertical neck hole perforations shown in FIG. 11-B.

FIG. 12-A shows construction details at the bottom 72 of a protective covering 14 where the bottom can be folded-up and attached in a manner that makes a protruding pocket to catch debris. A printed fold line 74 shows where the bottom should be folded-up. A printed attachment guideline 76 shows where a side of the folded-up bottom should be aligned and pressed to form a pocket. The inward-slanting guidelines cause the pocket to protrude. A pocket-making adhesive 78 (or cohesive) deposition provides a watertight attachment when the materials are pressed together. Unlike a neckband, a pocket attachment is not detached once the connections are made.

FIGS. 13-A and 13-B show roll and fanfold means of packaging and dispensing a length of continuous coverings. Covering separation perforations 80 allow for easy separation of an individual protective covering 14.

Operation—FIGS. 5 to 7 and 9 to 13

This application and the cross-referenced parent application were designed to meet the stringent requirements for a commercially viable product. To achieve this, the coverings were designed for high performance at a very low per unit cost. This application also focuses on the consumer convenience requirement by providing the easiest possible way to attach, fit and detach a protective covering.

FIGS. 5-B and 5-C show how neckband connections are made in many prior art disclosures. Two neckbands, 46 and 48, are overlapped and attached with a prior art attachment means 50 which is usually an adhesive. There are many weaknesses with this type of design. First, there is no fit adjustment when the attachment means describes a single point of contact. Second, in cases where the attachment means 50 is deposed on both neckbands, this gives rise to the adhesive-on-front-and-back cost and sticking problems. Third, attaching the neckbands behind the head is not a trivial task as it requires orienting the non-attachment-means neckband on top and liningup the neckband ends. Fourth, the prior art attachment cannot be detached in the easiest and simplest manner. Clearly, the easiest and simplest manner is to have a design that allows the neckbands to be detached by merely reaching behind one's neck, grasping both neckbands anywhere and pulling them apart. If the prior art neckbands shown were pulled that way, the connection would be torn apart and the neckbands could even tear. The prior art neckband connection must be released by: (1) finding the end of one neckband (working behind the neck in most cases) (2) grasping one neckband end with the fingers of one hand (3) using the fingers of the other hand to hold down the other neckband and then (4) pulling one neckband up and away from the other to break the connection. Fifth, since this type of connection resists being pulled apart in a direction parallel to the neckbands, it will not release easily in choking situation.

FIGS. 6-B and 6-C show how the invention's neckbands are connected to each other. Compared with the prior art design, this design has a fit adjustment, has the attachment means deposed on only one surface of a covering, is easy to attach, is easy to detach and releases easily in an emergency. After separation of the perforations, the procedure for connecting and fitting a covering is: (1) a covering is held in front of the user with the back of the covering facing the user (2) the covering is held by its neckbands with each neckband end being held between the thumb and fingers of one hand (3) the neckbands are moved into position behind the head while pulling the covering up to the neck (4) the neckbands are connected by pressing the thumbs together so that the deposed attachment means make contact with each other at the neckband ends (5) one thumb and finger combination pinches the neckband ends together to make a more positive connection while (6) the other thumb and finger combination slides along the neckbands toward the neck, extending the connection area as the elongated attachment means make additional contact. The complete process for attaching and fitting can be described simply as "touch-together-then-pinch-and-slide." The connection process is particularly easy because it is not necessary for the neckband ends to be aligned before making the initial contact. Since both neckbands have elongated attachment means, an end of one neckband can make initial contact at the midpoint of the other neckband for example. To detach the connection, all that is required is that the two neckbands be pulled apart by grasping the opposing neckbands anywhere. FIG. 6-B shows left 46 and right 48 neckbands after the contacting and fitting process makes them connected neckbands 56. The elongated attachment means 54 showing on FIG. 6-B is a portion not being used for the connection. The portion being used is shown in FIG. 6-C which is a view looking at the connected neckbands 56 from the side.

FIG. 7-B shows how a covering is distorted after the left neckband 46 and right neckband 48 become connected neckbands 56 by connecting their elongated attachment means 54. The covering as shown will not lie flat on a surface. FIG. 7-C shows the distortion at the connection area. This distortion produces a good fit however because the top of the covering tends to lay flat behind the neck while the remainder of the covering bends over the shoulder area and molds itself to the wearer's upper body.

FIGS. 9-A, 9-B and 9-C (and 7-A) show configurations that produce shorter neckbands. FIG. 9-A shows a configuration that gives a collar-like close fit around the neck. This configuration is useful for small neck sizes, wider material and situations where a tight neck fit is wanted. FIG. 9-B shows a configuration that lessens the need for long neckbands because a neck hole in the covering reduces the space at the back of a wearer's neck that must be bridged with neckbands. This configuration also does not require the removal of a piece of neck hole material 60. FIG. 9-C shows a configuration that gives an attachment result similar to that in FIG. 9-B but produces a separate piece of neck hole material 60 that can be used as a coaster or wipe. The configuration shown in FIG. 7-A is similar to that shown in FIG. 9-C except that the resulting neckbands from an oval neck hole are progressively wider and therefore stronger.

FIGS. 10-A and 10-B show configurations that produce longer neckbands. FIGS. 10-C and 10-D show configurations that provide a collar-like fit as in FIG. 9-A. The elongated attachment means 54 is shown deposed on the back side of the material to make the connection and fitting easier. The backside deposition is an alternative that could be used with any configuration.

FIGS. 11-A to 11-C shows how an elongated attachment means 54 is useful even when there are no neckbands to connect. By pressing the attachment means together as if they were on detached neckbands, an over-the-head covering can be fitted to a wearer. This is a particularly important feature with this type of covering because this design by necessity has a neck opening that is always too big at the neck area and leaves a large unprotected area on the wearer.

FIG. 12-B shows a protruding debris-catching pocket formed by folding-up the bottom 72 of a covering and pressing together adhesive (or cohesive) areas deposed at each side of the folded-up material. Coverings can be made without this pocket-making feature without affecting the rest of the covering. Furthermore, even when the feature is provided, it does not have to be used.

FIGS. 13-A and 13-B show how a plurality of connected coverings can be packaged and dispensed. Individual protective coverings 14 are obtained by tearing along the covering separation perforations 80.

Conclusion, Ramifications and Scope

Accordingly, this adjustable protective wearable covering invention has every feature that consumers have been waiting for. A dual surface material absorbs liquid spills that could otherwise run off while at the same time preventing those liquids from penetrating the material and reaching a wearer's skin and clothing. The preferred type and size of material to be used and the design ensure that a covering can be produced at a low cost that is comparable to the cost of paper toweling. Even though low in cost, the covering has high performance features. It has simple adjustment features to fit a broad range of neck sizes and allows a tighter fit at the neck if needed to catch spills running down the face. Neck hole material, if detached, is useful as a coaster and for wiping faces, hands and surfaces. The covering provides a protruding pocket to catch spills. The covering is easy to put on and take off and it can be used repeatedly. Easy removal is also a safety feature, avoiding the hazards of coverings that have straps or strings that are tied. One size can fit children and adults for low cost and convenience.

Furthermore, the material and design have broader applications, including:

One ramification relates to the mechanical attachment means located on the neckbands (see 64 and 66 on FIG. 8-B). These attachments could be constructed like those on disposable diapers in that they are folded upon themselves for protection before use and are then unfolded to make a connection to the opposing surface.

Another ramification relates to the single-side adhesive strip means located on just one neckband (see 68 on FIG. 8-C). A different surface material could be laminated on the other neckband to facilitate making a connection. For example, a piece of plastic film might be laminated on one neckband to provide a more receptive connecting surface for a diaper-like attachment means located on the other neckband.

Another ramification relates to where a liquid repellent back surface is applied. For example, if a repellent surface is plastic film, the film could be laminated in a discontinuous manner to a web of liquid absorbent material during a production process. The plastic film might not lie under the neckband and/or neck hole area in order to save material costs and make it easier for a user to separate the perforations.

Another ramification is a covering to protect the clothing of bottle-feeding infants. While it would use the same design and attachment means, an infant covering could be made from a narrower and shorter length of disposable material and not have a pocket. As a replacement for cloth bibs, it would offer many advantages. A cloth bib gets stiff after being wet and loses its absorbency. Also, a cloth bib can smell and become a breeding ground for bacteria with repeated reuse. Frequent laundering is required. The invention does not require that strings or straps be tied around an infant's neck. Strings and straps are time-consuming to tie, are hard to untie and pose a strangulation hazard. Furthermore, the invented covering can be discarded without hesitation when soiled because of its low unit cost.

Another ramification is the use of the same material and attachment means but a wider and/or longer size to cover the shoulders and/or back of a wearer. A wider and/or longer size will be useful for dental, medical, personal care and industrial applications.

Another ramification is the use of the same range-of-attachment-points-that-are-selectively-folded-together approach but to move the attaching point from behind the neck to one or both sides of a covering. This would mean that the neckbands would be replaced with a side cut or perforations for neck access and that the attachment means would be deposed vertically adjacent to one or both sides near the cut. Presumably, one could make the case that the attaching and detaching is easier with this configuration because these do not have to be done in the blind behind the neck.

Another ramification is the use of an unfolded covering with the neck hole material in place as a napkin for the lap. It provides broad coverage, does not slide off the lap and prevents liquid spills from penetrating.

Another ramification is the use of an unfolded covering with the neck hole material in place as a burp pad while feeding infants. It lies easily over a shoulder, provides broad coverage, does not slide off the lap or shoulder and prevents liquid spills from penetrating and staining clothing.

Although the description above contains much specificity, this should not be construed as limiting the scope of the invention but as merely providing illustrations of some of the presently preferred embodiments of this invention. For example, a covering can have other shapes as needed for specific applications. Also, there may be applications where other materials would be more appropriate.

Thus, the scope of the invention should be determined by the claims and their legal equivalents, rather than by the examples given.

What is claimed is:

1. A protective wearable covering composed of a sheet of flexible material being sized so as to cover the upper torso of a wearer to protect a wearer's skin or clothing, comprising:

a body with a bottom edge, a top edge, and first and second sides;

cuts or perforations in said coveting wherein said covering can be placed around the neck of a wearer when said perforations are broken;

a plurality of individual attachment points spaced down from said top edge and extending parallel to said top edge wherein the covering beneath the attachment points can be selectively folded to bring said individual attachment points into contact with each other in an increasing manner that allows for adjustable securement of the covering about the neck of a wearer.

2. The protective covering of claim 1 wherein said plurality of individual attachment points includes adhesive.

3. The protective covering of claim 1 wherein said flexible material includes a liquid absorbent front surface material.

4. The protective covering of claim 1 wherein said flexible material includes a liquid repellent back surface material.

5. The protective covering of claim 3 wherein said flexible material further includes a liquid repellent back surface material.

6. The protective covering of claim 3 wherein said front surface material comprises one or more layers of paper.

7. The protective covering of claim 4 wherein said back surface material comprises a plastic film.

8. The protective covering of claim 1 wherein said flexible material comprises paper treated with a liquid repellent material on one side.

9. The protective covering of claim 1 further comprising a fold line parallel to and spaced from said bottom edge;

printed guidelines extending adjacent both said first side and said second side, said guidelines extending diagonally inward beginning at said fold line and extending above said fold line;

adhesive located along said first side and said second side, said adhesive extending from said fold line downwardly wherein said bottom edge can be folded along said fold line such that adhesive is attached to a front surface of said covering at said printed guidelines to form a pocket having an open mouth.

10. The protective covering of claim 9 wherein said adhesive is further located diagonally upwardly from said fold line along said printed guidelines.

11. The protective covering of claim 1 wherein individual coverings are dispensed from a roll of continuous coverings, said coverings being separable by perforations.

12. The protective coverings of claim 1 wherein said coverings are dispensed individually from a holding means.

13. The protective covering of claim 1 wherein said covering has a design on a front side.

14. The protective covering of claim 1 wherein said cuts or perforations include cuts or perforations that encompass said attachment points and define neckbands which, when said perforations are broken, are unattached to the covering at one end of each said neckband and are attached to said covering at the other end of each said neckband.

15. The protective covering of claim 1 wherein said cuts or perforations include cuts or perforations that form a neck-receiving opening in said covering when said perforations are broken.

16. The protective covering of claim 14 wherein said cuts or perforations further includes cuts or perforations that form a neck-receiving opening in said covering when said perforations are broken.

17. The protective covering of claim 15 wherein material removed from the covering to form said neck-receiving opening can be used as a coaster or wipe.

* * * * *